US011692722B2

(12) United States Patent
Takao

(10) Patent No.: US 11,692,722 B2
(45) Date of Patent: Jul. 4, 2023

(54) HUMIDIFYING DEVICE

(71) Applicant: Panasonic Intellectual Property Management Co., Ltd., Osaka (JP)

(72) Inventor: Hiroki Takao, Osaka (JP)

(73) Assignee: PANASONIC INTELLECTUAL PROPERTY MANAGEMENT CO, LTD., Osaka (JP)

( * ) Notice: Subject to any disclaimer, the term of this patent is extended or adjusted under 35 U.S.C. 154(b) by 90 days.

(21) Appl. No.: 17/358,273

(22) Filed: Jun. 25, 2021

(65) Prior Publication Data

US 2021/0404681 A1 Dec. 30, 2021

Related U.S. Application Data

(60) Provisional application No. 63/044,449, filed on Jun. 26, 2020.

(51) Int. Cl.

| | |
|---|---|
| ***F24F 11/00*** | (2018.01) |
| ***F24F 11/63*** | (2018.01) |
| *F24F 110/20* | (2018.01) |
| *F24F 140/00* | (2018.01) |
| *F24F 110/10* | (2018.01) |

(52) U.S. Cl.

CPC ..... *F24F 11/0008* (2013.01); *F24F 11/63* (2018.01); *F24F 2110/10* (2018.01); *F24F 2110/20* (2018.01); *F24F 2140/00* (2018.01)

(58) Field of Classification Search

CPC .... F24F 11/0008; F24F 11/63; F24F 2110/20; F24F 2110/12; F24F 2110/22; F24F 2140/00; F24F 3/1405; F24F 6/12

See application file for complete search history.

(56) References Cited

U.S. PATENT DOCUMENTS

2011/0300789 A1* 12/2011 Kinoshita ..... H05K 7/20745 454/184
2012/0234527 A1* 9/2012 Murayama ..... H05K 7/20709 165/287
2013/0005235 A1* 1/2013 Ootani ..... H05K 7/20836 454/184

(Continued)

FOREIGN PATENT DOCUMENTS

CN 101846364 9/2010
CN 208702208 4/2019

(Continued)

OTHER PUBLICATIONS

Extended European Search Report dated Nov. 29, 2021 in corresponding European Patent Application No. 21181780.4.

*Primary Examiner* — Nelson J Nieves
(74) *Attorney, Agent, or Firm* — Wenderoth, Lind & Ponack, L.L.P.

(57) ABSTRACT

A humidifying device includes an air inlet, an internal air passage through which air taken in from the air inlet passes, a first thermometer that measures a temperature of the air taken in from the air inlet, a first hygrometer that measures a humidity of the air taken in from the air inlet, a cooler installed in a path of the internal air passage, and a cooling control unit that controls the cooler. The cooling control unit changes a cooling intensity of the cooler in a case where values measured by the first thermometer and the first hygrometer are out of a predetermined range.

12 Claims, 5 Drawing Sheets

(56) References Cited

U.S. PATENT DOCUMENTS

| | | | | |
|---|---|---|---|---|
| 2013/0299157 | A1* | 11/2013 | Murayama | H05K 7/20745 165/252 |
| 2014/0159634 | A1 | 6/2014 | Yokoyama | |
| 2014/0349563 | A1* | 11/2014 | Honda | F24F 1/0035 454/256 |
| 2015/0021796 | A1* | 1/2015 | Peczalski | F24F 11/0008 261/128 |
| 2015/0198390 | A1* | 7/2015 | Ootomo | F28D 21/0015 165/133 |
| 2016/0352062 | A1 | 12/2016 | Takigawa et al. | |
| 2017/0108231 | A1* | 4/2017 | Hasegawa | F24F 3/147 |
| 2018/0259208 | A1* | 9/2018 | Wang | F24F 11/89 |
| 2018/0259216 | A1* | 9/2018 | Zhang | F24F 11/41 |
| 2019/0257533 | A1* | 8/2019 | Tak | F24F 8/40 |
| 2019/0308207 | A1* | 10/2019 | Matsuoka | F24F 6/04 |
| 2019/0323714 | A1* | 10/2019 | Cui | F24F 3/14 |
| 2019/0390862 | A1* | 12/2019 | Yoon | F25B 25/00 |
| 2020/0254385 | A1* | 8/2020 | Siann | F24F 3/14 |
| 2020/0263895 | A1* | 8/2020 | Motodani | F24F 11/74 |
| 2020/0271338 | A1* | 8/2020 | Kajiyama | F24F 6/04 |
| 2021/0094058 | A1* | 4/2021 | Fujiwara | F24F 11/30 |
| 2021/0102719 | A1* | 4/2021 | Whitehead | H05K 7/20972 |
| 2021/0310676 | A1* | 10/2021 | Khoury | F24F 11/526 |
| 2021/0310684 | A1* | 10/2021 | Sasaki | F24F 11/63 |
| 2021/0348777 | A1* | 11/2021 | Zavodny | F24F 6/12 |

FOREIGN PATENT DOCUMENTS

| | | |
|---|---|---|
| EP | 2 236 951 | 10/2010 |
| EP | 2 806 225 | 11/2014 |
| JP | 2008-204991 | 9/2008 |
| JP | 2009-063251 | 3/2009 |
| JP | 2011-167736 | 9/2011 |
| JP | 2014-115012 | 6/2014 |
| JP | 2016-225504 | 12/2016 |
| WO | 2018/037671 | 3/2018 |

* cited by examiner

HUMIDIFYING DEVICE

CROSS-REFERENCE TO RELATED APPLICATIONS

This application is based on and claims priority under 35 USC 119 from U.S. Provisional Application No. 63/044,449 filed on Jun. 26, 2020, the contents of which are incorporated herein by reference.

TECHNICAL FIELD

The present disclosure relates to a humidifying device that controls the humidity contained in the air.

BACKGROUND ART

JP-A-2009-63251 discloses a ventilation system that automatically operates so as to detect temperature or humidity and prevent dew condensation in a room. The ventilation system includes: a fan that exhausts or supplies air in the room; temperature detection devices which are installed at least at two places in the room and detect temperatures; and a calculation device that calculates a water vapor amount contained in the room based on a relationship between a humidity detected by humidity detection device that detects the humidity in the room and the temperatures detected by the temperature detection devices, and computes a temperature difference that causes water vapor saturation and dew condensation. In a case where it is determined that there is a temperature difference that causes dew condensation, the ventilation system exhausts or supplies air by the fan so as to prevent dew condensation in the room. Accordingly, dew condensation can be prevented by efficiently sucking air into a place where dew condensation is likely to occur.

SUMMARY OF INVENTION

The present disclosure provides a humidifying device that ensures a certain level of humidity or higher in order to generate ions by using an electrostatic atomizing device in a low humidity environment such as in an aircraft.

A humidifying device according to an embodiment of the present disclosure includes: a first thermometer configured to measure a temperature inside the humidifying device, a first hygrometer configured to measure a humidity inside the humidifying device, an air inlet, an internal air passage through which air taken in from the air inlet passes, an air outlet from which the air that has passed through the internal air passage is discharged, a cooler installed in a path of the internal air passage, and a cooling control unit that controls the cooler, in which the cooling control unit changes a cooling intensity of the cooler in a case where values measured by the first thermometer and the first hygrometer are out of a predetermined range.

According to the present disclosure, it is possible to ensure a certain level of humidity or higher in order to generate ions by using an electrostatic atomizing device in a low humidity environment such as in an aircraft. For example, it is effective to keep the humidity of air within a certain range without providing a water tank or the like.

DESCRIPTION OF EMBODIMENTS

Figure 1:
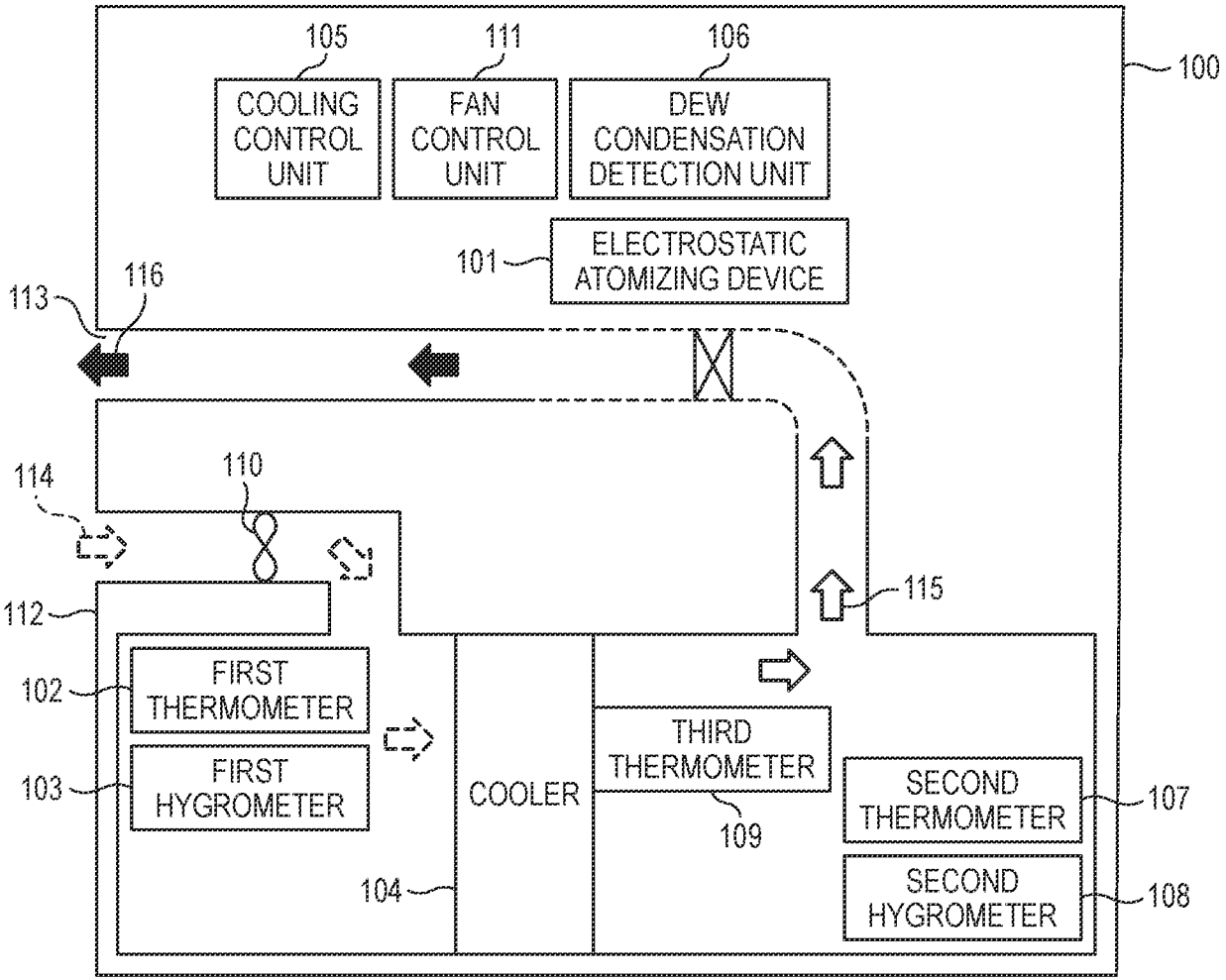
FIG. 1 is a plan view illustrating a state of work in which a humidifying device according to an embodiment is used.

In an electrostatic atomizing device, a certain level of humidity or higher is required to generate ions. However, in general, the humidity inside an aircraft is extremely low. This is because aircraft usually takes in air from the outdoor air. At an altitude of 10 km, the ambient temperature is approximately negative 55 degrees Celsius, and thus, even when the air is warmed, the water vapor amount contained in the air is extremely small. The life of an aircraft is generally approximately 30 years, and is used for a long period of time. Since the structure of the aircraft is mainly made of metal, the humidification is not performed until reaching 40% to 50% of humidity in which humans can feel comfortable in order to avoid fatigue fracture due to repeated expansion and contraction caused by corrosion and water adhesion. As described above, unlike the inside of a house, the humidity inside the aircraft is extremely low, and thus, the moisture required for the electrostatic atomizing device cannot be supplied from the air. Accordingly, a humidifying device is required.

Meanwhile, in the special environment of an aircraft, a tank filled with water is not placed in order to avoid equipment troubles due to water leakage. When the entire aircraft is humidified, there is a risk of corrosion and fatigue fracture as described above. Therefore, in the following embodiment, a method is adopted in which the temperature of the air immediately before being taken into the electrostatic atomizing device is lowered by a cooler to relatively raise the humidity. However, when the temperature of the air is lowered excessively, dew condensation occurs when the air temperature exceeds a dew-point temperature, and water is generated. Accordingly, there is a possibility of equipment failure.

The method of preventing dew condensation by using an air flow by a fan as disclosed in JP-A-2009-63251 does not always prevent dew condensation, and thus, a fundamental solution to these problems is not provided. Therefore, in the following embodiments, it is possible to appropriately control the cooler to achieve the target humidity and to prevent dew condensation.

Hereinafter, embodiments in which the humidifying device according to the disclosure is specifically disclosed will be described in detail with reference to the drawings as appropriate. However, more detailed description than necessary may be omitted. For example, detailed descriptions of already well-known parts and duplicate descriptions for substantially the same configuration may be omitted. This is to avoid unnecessary redundancy of the following description and to facilitate the understanding of those skilled in the art. The accompanying drawings and the following description are provided for those skilled in the art to fully understand the disclosure, and are not intended to limit the subject described in the claims.

1. Overview

First, the outline of a humidifying device 100 according to an embodiment will be described with reference to FIG.

1. FIG. 1 is a plan view illustrating a state of work in which the humidifying device 100 according to the embodiment is used. An object of the humidifying device 100 according to the embodiment is to ensure a certain level of humidity or higher in order to generate ions 116 by using an electrostatic atomizing device 101 in a low humidity environment such as in an aircraft.

In the humidifying device 100 according to the embodiment, air 114 is taken in from an air inlet 112. The humidifying device 100 cools the air 114 taken in by a cooler 104 to lower the relative humidity. By taking the cooled air 115 into the electrostatic atomizing device 101, the ions 116 are generated in a low humidity environment and discharged together with the air through the air outlet 113.

2. Configuration

Figure 2:
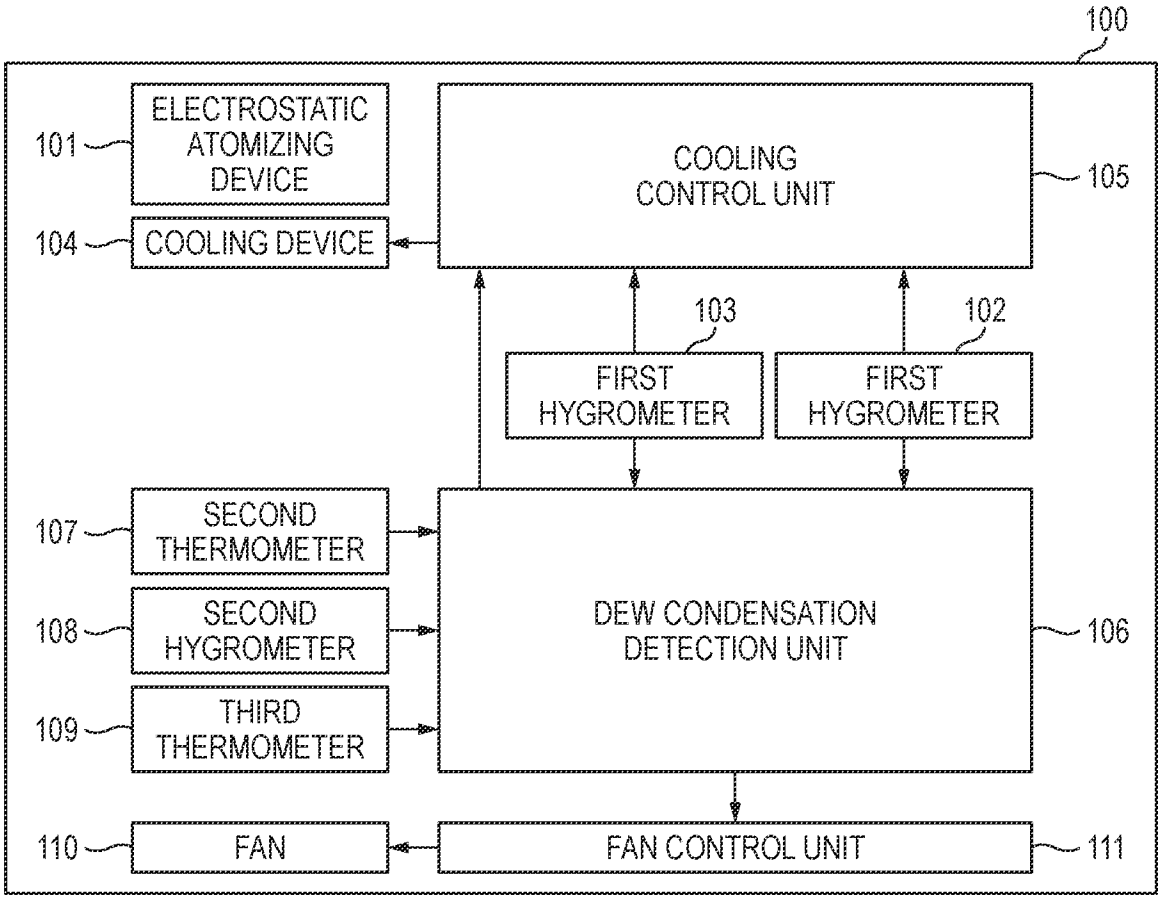
FIG. 2 is a block diagram of the humidifying device according to the embodiment.

Hereinafter, the humidifying device 100 according to the embodiment will be described in detail with reference to FIGS. 1 to 2. FIG. 2 is a block diagram of the humidifying device according to the embodiment.

The electrostatic atomizing device 101 in the disclosure is a device that uses an electrostatic atomization technology that applies a high voltage to water in the air to generate charged fine particle water (that is, ions). As can be seen from the action on water in the air, a certain level of absolute humidity or higher is required to cause the electrostatic atomizing device 101 to generate ions. To give a specific example, a humidity of approximately 25% is required for air having a temperature of 25° C. In the disclosure, the electrostatic atomizing device 101 is attached, for example, to a position where the air after cooling by the cooler 104 is taken in, and to a position where the air is taken in even in a case where cooling by the cooler 104 is not performed.

A first thermometer 102 in the disclosure is a thermometer attached to a position where the temperature of the air before cooling by the cooler 104 is measured, measures and detects the temperature in the air before cooling, and notifies a cooling control unit 105 and a dew condensation detection unit 106 of the information. Examples of the thermometer include a digital thermometer using a thermistor, a thermocouple thermometer that connects two different types of metal wires to each other to form one circuit, and measures the temperature from the voltage applied to the circuit, and the like.

A first hygrometer 103 in the disclosure is a hygrometer attached to a position where the humidity of the air before cooling by the cooler 104 is measured, measures and detects the humidity in the air before cooling, and notifies the cooling control unit 105 and the dew condensation detection unit 106 of the information. Examples of the hygrometer include a capacitive digital hygrometer that uses the change in amount of capacitance that can be stored depending on the state of the moisture-sensitive film sandwiched between the electrodes, an electric resistance type hygrometer that measures the humidity from the degree of the change by using the properties in which the moisture-sensitive film contains moisture, ion conduction occurs, and electric resistance is reduced, and the like.

The cooler 104 in the disclosure is hardware that cools the ambient air according to an instruction from the cooling control unit 105. Examples of the cooler include a Perche element, which is one type of plate-shaped semiconductor thermoelectric element using the Perche effect, a heat pump, which is a technology for transferring heat from a low temperature part to a high temperature part using a heat medium or a semiconductor.

The cooling control unit 105 in the disclosure is configured by using software and hardware for determining whether the relative humidity required for the electrostatic atomizing device 101 can be ensured from the information obtained from the first thermometer 102 and the first hygrometer 103. The required relative humidity means a preset range of relative humidity based on some condition. For example, the required relative humidity is a range of relative humidity required for electrostatic atomization, which is predetermined by the performance of the electrostatic atomizing device 101. Depending on the performance of the electrostatic atomizing device 101, a required temperature range may be determined, in addition to the required humidity range. In a case where it is determined that the required relative humidity cannot be ensured, the cooling control unit 105 drives the cooler 104 or increases the output (that is, the cooling intensity, and the same applies hereinafter). In a case where it is determined that the required relative humidity has already been ensured, the cooling control unit 105 stops cooling by the cooler 104 or reduces the output. When the cooling control unit 105 receives information from the dew condensation detection unit 106 that there is a possibility of occurrence of dew condensation or that dew condensation has occurred, the cooling unit 105 stops cooling by the cooler 104 or weakens the output.

The cooling control unit 105 is configured with, for example, a microcomputer, a signal line for communicating with peripheral devices, and firmware for controlling the signal line.

A second thermometer 107 in the disclosure is a thermometer attached to a position where the temperature of the air after cooling by the cooler 104 is measured, measures and detects the temperature in the air after cooling, and notifies the dew condensation detection unit 106 of the information. Examples of the thermometer include a digital thermometer using a thermistor, a thermocouple thermometer that connects two different types of metal wires to each other to form one circuit, and measures the temperature from the voltage applied to the circuit, and the like.

A second hygrometer 108 in the disclosure is a hygrometer attached to a position where the humidity of the air after cooling by the cooler 104 is measured, measures and detects the humidity in the air after cooling, and notifies the dew condensation detection unit 106 of the information. Examples of the hygrometer include a capacitive digital hygrometer that uses the change in amount of capacitance that can be stored depending on the state of the moisture-sensitive film sandwiched between the electrodes, an electric resistance type hygrometer that measures the humidity from the degree of the change by using the properties in which the moisture-sensitive film contains moisture, ion conduction occurs, and electric resistance is reduced, and the like.

A third thermometer 109 in the disclosure is a thermometer attached to a position where the surface temperature of the cooler 104 is measured, measures and detects the surface temperature of the cooler 104, and notifies the dew condensation detection unit 106 of the information. Examples of the thermometer include a digital thermometer using a thermistor, a thermocouple thermometer that connects two different types of metal wires to each other to form one circuit, and measures the temperature from the voltage applied to the circuit, and the like.

The dew condensation detection unit 106 in the disclosure uses the information provided by the first thermometer 102, the first hygrometer 103, the second thermometer 107, and the second hygrometer 108, to calculate the absolute humidity of the air around each of the air inlet 112 and the air outlet 113, and detects the occurrence of dew condensation from the difference. This is because, the absolute humidity represents the amount of water vapor itself contained in the air, and thus, in a case where there is a difference between before and after cooling, it is considered that moisture is lost from the air in the process, that is, dew condensation occurs.

The dew condensation detection unit 106 may detect that there is a possibility of occurrence of dew condensation by the following procedure. The dew condensation detection unit 106 calculates the dew-point temperature of the air before cooling, by using the information of the first thermometer 102 and the first hygrometer 103. The dew condensation detection unit 106 determines that there is a possibility of occurrence of dew condensation in a case where the difference between the dew-point temperature and the temperature acquired by the second thermometer 107 or the third thermometer 109 is smaller than a predetermined threshold value.

The dew condensation detection unit 106 notifies the cooling control unit 105 of the detected result.

A fan 110 in the disclosure causes the air to flow through the cooler 104. The fan 110 rotates at the rotating speed instructed by a fan control unit 111.

The fan control unit 111 in the disclosure is software or hardware for controlling the rotating speed of the fan 110. Specifically, a configuration configured with a microcomputer that controls the voltage for driving the fan and the control software thereof can be considered. When the dew condensation detection unit 106 detects that dew condensation has occurred or is likely to occur, the fan control unit 111 controls the rotating speed of the fan 110 such that the fan 110 rotates at a higher speed than that in a case where no dew condensation is detected.

3. Operation

Figure 3:
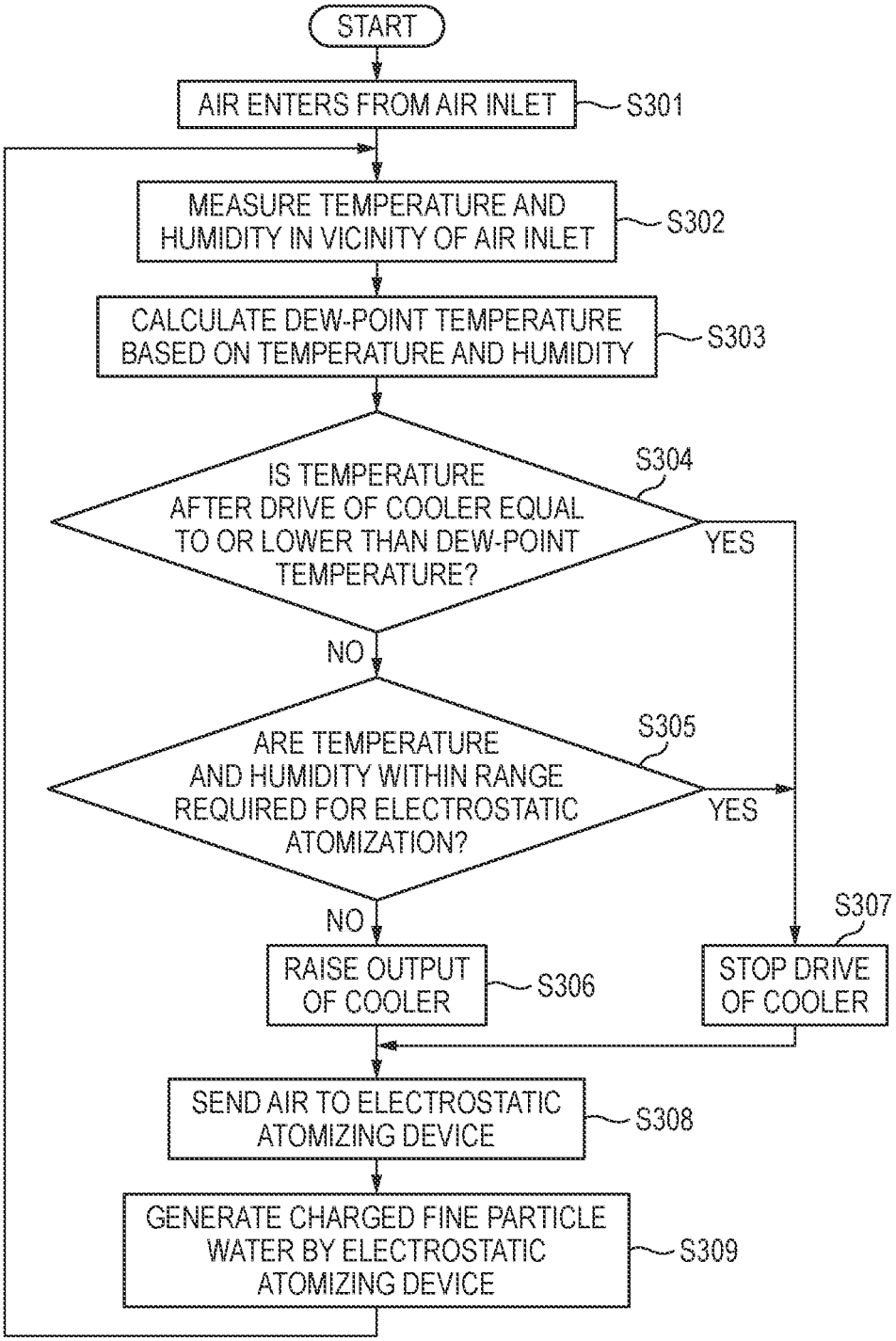
FIG. 3 is a data flow diagram describing an operation of the humidifying device according to the embodiment.
Figure 4:
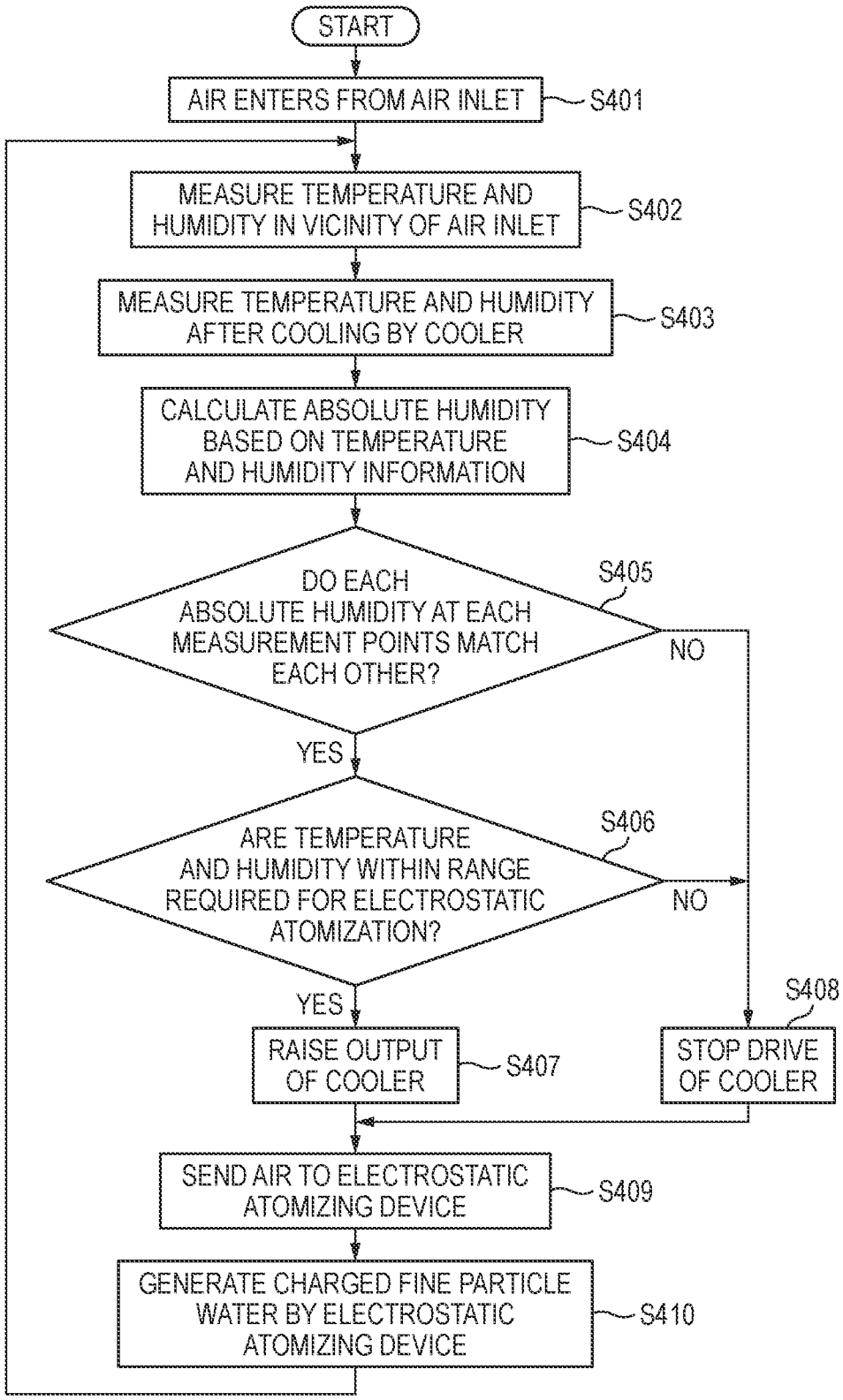
FIG. 4 is a data flow diagram describing the operation of the humidifying device according to the embodiment.
Figure 5:
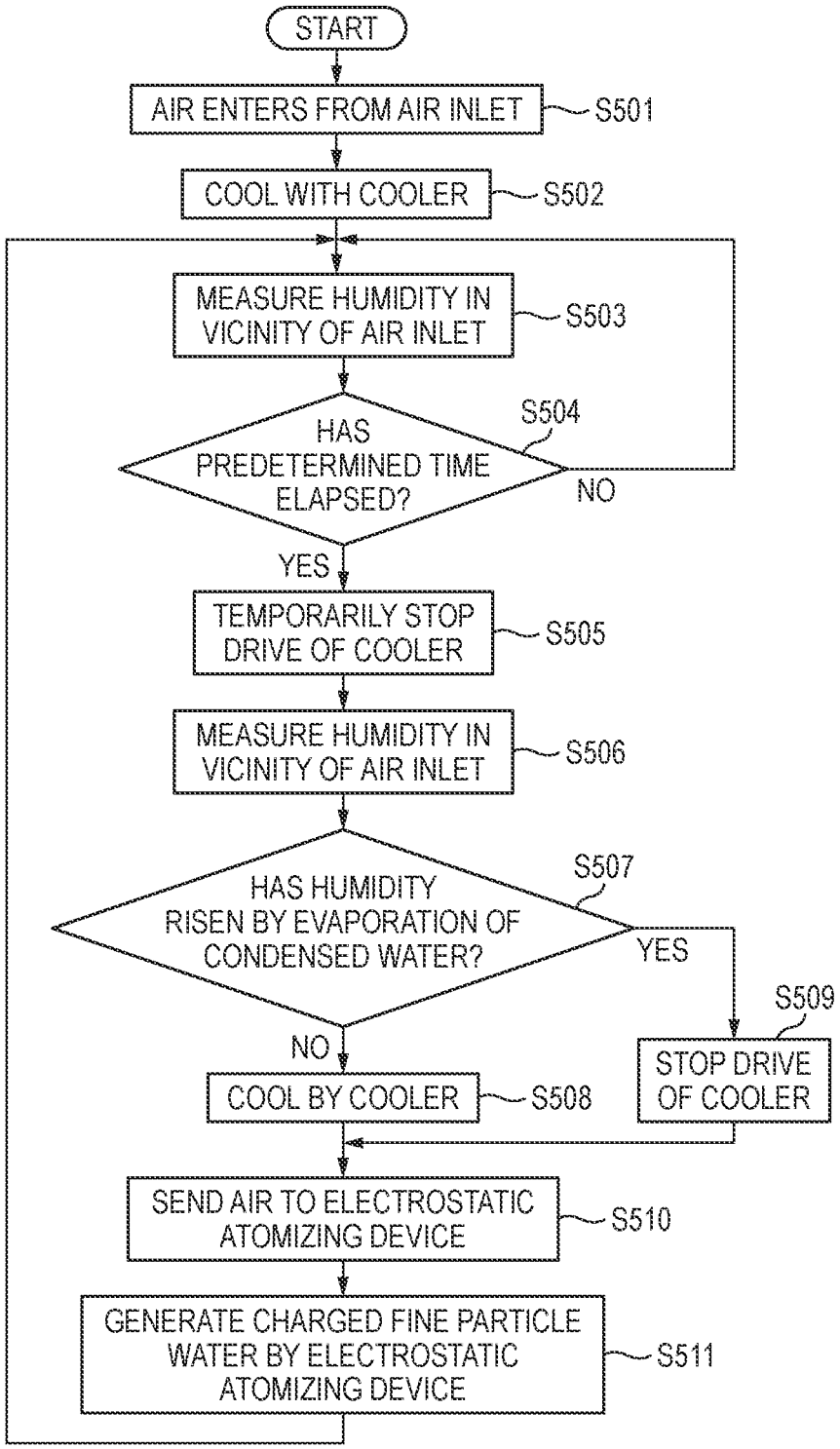
FIG. 5 is a data flow diagram describing the operation of the humidifying device according to the embodiment.

Hereinafter, the operation of the humidifying device 100 according to the embodiment will be described in detail with reference to FIGS. 3 to 5. FIGS. 3 to 5 are data flow diagrams describing the operation of the humidifying device according to the embodiment. In order to make the description simple, simple specific examples are used for the data or estimation algorithms exchanged between each component, but these are merely examples. As described in the description of the configuration, various data contents and formats and estimation algorithms can be applied.

3-1 Embodiment 1: Humidification Using Temperature Estimated from Cooling Performance of Cooler The operation of the humidifying device 100 according to Embodiment 1 will be described with reference to FIG. 3. Hereinafter, the humidifying device 100 may be simply abbreviated as "device".

First, the humidifying device 100 takes in the air outside the device from the air inlet 112 into the device using the fan 110. The fan 110 is continuously driven to continuously send air into the device (S301).

Next, the first thermometer 102 and the first hygrometer 103 measure the temperature and humidity of the air flowing in from the air inlet 112, and notify the cooling control unit 105 and the dew condensation detection unit 106 of the measurement results (S302).

The dew condensation detection unit 106 obtains the dew-point temperature using an approximate expression of the saturated water vapor pressure of Tetens based on the information notified from the first thermometer 102 and the first hygrometer 103 (S303).

The dew condensation detection unit 106 estimates the temperature of the air in the vicinity of the cooler in a case where the cooler is driven, from the cooling performance of the cooler 104 known in advance. For example, in a case where the cooler 104 is driven with the weakest output, it is estimated how many degrees the temperature of the air introduced from the air inlet 112 at the temperature measured by the first thermometer 102 will drop due to cooling. The temperature after cooling is estimated by an algorithm based on the result measured in advance at the design stage of the equipment. For example, the temperature lowered by cooling may be an empirical fixed value, or a correspondence table of the temperature measured by the first thermometer 102 and the temperature after cooling may be provided. The temperature after cooling may be estimated by AI or simulation. The dew condensation detection unit 106 determines whether the estimated temperature of the air after cooling is lower than the dew-point temperature obtained by calculation in step S303 (S304).

In a case where the temperature of the air after cooling is lower than the dew-point temperature, it is estimated that there is a high possibility of occurrence of dew condensation in the vicinity of the cooler. Here, the dew condensation detection unit 106 notifies the cooling control unit 105 of the possibility of occurrence of dew condensation. In response thereto, the cooling control unit 105 stops driving the cooler 104. Accordingly, the occurrence of dew condensation can be prevented in advance and the risk of equipment failure due to water generated by dew condensation can be reduced (S307).

In a case where the estimated temperature of the air after cooling is higher than the dew-point temperature, the cooling control unit 105 determines whether the temperature and humidity measured by the first thermometer 102 and the first hygrometer 103 is within the preset range of the temperature and humidity. In the embodiment, a case of being within the preset range of the temperature and humidity, means a case where the temperature and humidity measured by the first thermometer 102 and the first hygrometer 103 are within the range of the combination of the temperature and humidity, in which the electrostatic atomizing device 101 can generate the charged fine particle water. The definition of the range may be set only for the humidity (S305).

In a case where the temperature and humidity are within the preset range of the temperature and humidity, the cooling control unit 105 stops driving the cooler 104. This is because it is not necessary to raise the relative humidity of the air (S307).

In a case where the temperature and humidity are out of the preset range of the temperature and humidity, the cooling control unit 105 drives the cooler 104 to cool the air. Here, the process performed on the cooler 104 may be a process of switching on the cooler to start driving, or in a case where the driving is already started, the output may be increased even while maintaining the driving. In any case, the cooler 104 performs a process for cooling the air introduced from the air inlet 112 (S306).

The air that has passed the vicinity of the cooler 104 is induced to the electrostatic atomizing device 101 (S308).

The electrostatic atomizing device 101 generates charged fine particle water by applying a voltage to the induced air (S309).

Next, the process returns to step S302 again. Accordingly, the electrostatic atomizing device 101 can stably generate charged fine particle water.

In the embodiment, it has been described that the driving of the cooler is stopped in a case of the transition to step S307 by the determination in step S305, but it is not always necessary to stop completely. For example, the output may be weakened. For example, in a case where the humidifying device 100 itself generates heat and the structure is applied in which the air introduced into the device is heated by the humidifying device 100 itself, in order to maintain the temperature of the air introduced into the device, it is considered that the cooling device 104 is driven to some extent.

In the embodiment, it is assumed to use in an environment in which the humidity is extremely low, such as in an aircraft, and thus, only cooling the air to raise the humidity was mentioned in step S306, but in principle, a process of lowering the relative humidity by driving a heater is also assumed in order to induce the temperature and humidity to be within a preset range.

In the process of estimating the temperature of the air after cooling in step S304, the temperature that can be acquired by the second thermometer 107 or the third thermometer 109 may be used. The temperature measured by the second thermometer 107 is the temperature after being actually cooled by the cooling device 104. It is assumed that the third thermometer 109 easily estimates the temperature of the air that has passed through the cooling device 104, from the temperature of the surface of the cooling device 104, empirically or by using simulation or the like.

3-2 Embodiment 2: Humidification Using Absolute Humidity

The operation of the humidifying device 100 according to Embodiment 2 will be described with reference to FIG. 4.

First, the humidifying device 100 takes in the air outside the device from the air inlet 112 into the device using the fan 110. The fan 110 is continuously driven to continuously send air into the device (S401).

Next, the first thermometer 102 and the first hygrometer 103 measure the temperature and humidity of the air flowing in from the air inlet 112, and notify the cooling control unit 105 and the dew condensation detection unit 106 of the measurement results (S402).

Next, the second thermometer 107 and the second hygrometer 108 measure the temperature and humidity of the air after being cooled by the cooler 104, and notify the cooling control unit 105 and the dew condensation detection unit 106 of the measurement results (S403).

The dew condensation detection unit 106 obtains the absolute humidity at each measurement point using an approximate expression of saturated water vapor pressure of Tetens, based on the information notified from the first thermometer 102 and the first hygrometer 103, and the information notified from the second thermometer 107 and the second hygrometer 108 (S404).

The dew condensation detection unit 106 confirms whether each absolute humidity at each of the obtained measurement points match each other (S405). Here, the property is used that the absolute humidity does not change even when the temperature changes as long as the moisture in the air is not lost.

In a case where each absolute humidity do not match each other, it is estimated that there is a high possibility of occurrence of dew condensation in the vicinity of the cooler. Here, the dew condensation detection unit 106 notifies the cooling control unit 105 of the possibility of occurrence of dew condensation. In response thereto, the cooling control unit 105 stops driving the cooler 104. Accordingly, further occurrence of dew condensation can be prevented and the risk of equipment failure due to water generated by dew condensation can be reduced (S408).

In a case where each absolute humidity match each other, the cooling control unit 105 determines whether the temperature and humidity measured by the second thermometer 107 and the second hygrometer 108 is within the preset range of the temperature and humidity. In the embodiment, a case of being within the preset range of the temperature and humidity, means a case where the temperature and humidity measured by the second thermometer 107 and the second hygrometer 108 are within the range of the combination of the temperature and humidity, in which the electrostatic atomizing device 101 can generate the charged fine particle water. The definition of the range may be set only for the humidity (S406).

In a case where the temperature measured by the second thermometer and the humidity measured by the second hygrometer are within the preset range of the temperature and humidity, the cooling control unit 105 stops driving the cooler 104. This is because it is not necessary to further raise the relative humidity of the air (S408).

In a case where the temperature and humidity are out of the preset range of the temperature and humidity, the cooling control unit 105 drives the cooler 104 to cool the air. Here, the process performed on the cooler 104 may be a process of switching on the cooler to start driving, or in a case where the driving is already started, the output may be increased even while maintaining the driving. In any case, the cooler 104 performs a process for cooling the air introduced from the air inlet 112 (S407).

The air that has passed the vicinity of the cooler 104 is induced to the electrostatic atomizing device 101 (S409).

The electrostatic atomizing device 101 generates charged fine particle water by applying a voltage to the induced air (S410).

Next, the process returns to step S402 again. Accordingly, the electrostatic atomizing device 101 can stably generate charged fine particle water.

In the embodiment, it has been described that the driving of the cooler is stopped in a case of the transition to step S408 by the determination in step S406, but it is not always necessary to stop completely. For example, the output may be weakened. For example, in a case where the humidifying device 100 itself generates heat and the structure is applied in which the air introduced into the device is heated by the humidifying device 100 itself, in order to maintain the temperature of the air introduced into the device, it is considered that the cooling device 104 is driven to some extent.

In the embodiment, it is assumed to use in an environment in which the humidity is extremely low, such as in an aircraft, and thus, only cooling the air to raise the humidity was mentioned in step S407, but in principle, a process of lowering the relative humidity by driving a heater is also assumed in order to induce the temperature and humidity to be within a preset range.

In the embodiment, it has been described that, in the determination in step S405, it is determined whether each absolute humidity at each of the obtained measurement points do not match each other, but each absolute humidity are not always necessary to completely match each other. For example, a process of setting a certain threshold value and determining whether the humidity is within the range of the threshold value can also be considered.

Instead of measuring the temperature of the air after cooling with the second thermometer 107, the temperature of the air after cooling may be estimated using the third thermometer 109. It is assumed that the third thermometer 109 easily estimates the temperature of the air that has passed through the cooling device 104, from the temperature of the surface of the cooling device 104, empirically or by using simulation or the like.

3-3 Embodiment 3: Humidification Using Intermittent Operation of Cooling Device The operation of the humidifying device 100 according to Embodiment 3 will be described with reference to FIG. 5.

First, the humidifying device 100 takes in the air outside the device from the air inlet 112 into the device using the fan 110. The fan 110 is continuously driven to continuously send air into the device (S501).

Next, cooling by the cooling device 104 is started (S502).

The first hygrometer 103 measures the humidity of the air flowing in from the air inlet 112, and notifies the dew condensation detection unit 106 of the measurement result (S503).

It is determined whether a predetermined time has elapsed, and when a predetermined time has not elapsed, the process returns to step S503 (S504). The predetermined time defined here varies depending on the cooling performance of the cooling device 104.

In a case where the predetermined time has elapsed, the drive of the cooler is temporarily stopped (S505).

Next, the humidity of the air flowing in from the air inlet 112 is measured again, and the dew condensation detection unit 106 was notified of the measurement result (S506).

The dew condensation detection unit 106 compares each humidity measured in step S503 and step S506 to determine whether the humidity in step S506 exceeds the humidity in step S503 (S507). In a case where dew condensation occurs around the cooling device 104, it is considered that, when the operation of the cooling device 104 is stopped, the temperature around the cooling device 104 temporarily rises and the water adhering due to the dew condensation evaporates. In other words, in a case where the humidity at the time of step S506 is higher than the humidity at the time of step S503, it is possible to estimate that there is a high possibility that water adheres to the periphery of the cooling device 104 due to dew condensation.

In a case where the humidity in step S506 exceeds the humidity in step S503, the dew condensation detection unit 106 notifies the cooling control unit 105 of the possibility of dew condensation. In response thereto, the cooling control unit 105 stops driving the cooler 104. Accordingly, the humidifying device 100 can prevent further occurrence of dew condensation and reduce the risk of equipment failure due to water generated by dew condensation (S509).

In a case where the humidity in step S506 does not exceed the humidity in step S503, the cooling control unit 105 drives the cooler 104 to cool the air. Here, the process performed on the cooler 104 may be a process of switching on the cooler to start driving, or in a case where the driving is already started, the output may be increased even while maintaining the driving. In any case, the cooler 104 performs a process for cooling the air introduced from the air inlet 112 (S508).

The air that has passed the vicinity of the cooler 104 is induced to the electrostatic atomizing device 101 (S510).

The electrostatic atomizing device 101 generates charged fine particle water by applying a voltage to the induced air (S511).

Next, the process returns to step S503 again. Accordingly, the electrostatic atomizing device 101 can stably generate charged fine particle water.

In the embodiment, the first hygrometer 103 installed around the air inlet 112 is used to measure the humidity, but when the humidity around the cooling device 104 can be measured, any hygrometer installed anywhere may be used. For example, the second hygrometer 107 may be used.

Since the above-described embodiment is for exemplifying the technology in the disclosure, various changes, replacements, additions, omissions, and the like can be made within the scope of claims or the equivalent scope thereof.

REFERENCE SIGNS LIST

100 humidifying device
101 electrostatic atomizing device
102 first thermometer
103 first hygrometer
104 cooler
105 cooling control unit
106 dew condensation detection unit
107 second thermometer
108 second hygrometer
109 third thermometer
110 fan
111 fan control unit
112 air inlet
113 air outlet
114 air before cooling
115 air after cooling
116 air having ions

What is claimed is:

1. A humidifying device comprising:

a first thermometer configured to measure a temperature inside the humidifying device;

a first hygrometer configured to measure a humidity inside the humidifying device;

an air inlet;

an internal air passage through which air taken in from the air inlet passes;

an air outlet from which the air that has passed through the internal air passage is discharged;

a cooler installed in a path of the internal air passage; and a hardware controller configured to execute at least one program to control the cooler, wherein the hardware controller changes a cooling intensity of the cooler in a case where values measured by the first thermometer and the first hygrometer are out of a predetermined range, wherein the humidifying device further comprises:

a second thermometer installed between the cooler and the air outlet; and a second hygrometer installed between the cooler and the air outlet, wherein the hardware controller is further configured to execute a program to detect that dew condensation has occurred in the humidifying device, by using the temperature measured by the first thermometer, the humidity measured by the first hygrometer, the temperature measured by the second thermometer, and the humidity measured by the second hygrometer, and calculate a water content per unit substance amount by using the temperature measured by the first thermometer and the humidity measured by the first hygrometer, and wherein the hardware controller is further configured to execute a program to calculate a water content per unit substance amount by using the temperature measured by the second thermometer and the humidity measured by the second hygrometer, and it is determined that the dew condensation has occurred in a case where a difference between 1) a value calculated for the water content per unit substance amount by using the temperature measured by the first thermometer and the humidity measured by the first hygrometer and 2) a value calculated for the water content per unit substance amount by using the temperature measured by the second thermometer and the humidity measured by the second hygrometer, is equal to or greater than a predetermined value.

2. The humidifying device according to claim 1, wherein the first thermometer and the first hygrometer are provided between the cooler and the air inlet.

3. The humidifying device according to claim 1, further comprising:

an electrostatic atomizing generator installed between the cooler and the air outlet in the path of the internal air passage.

4. The humidifying device according to claim 1, wherein the hardware controller strengthens the cooling intensity of the cooler in a case where the temperature measured by the first thermometer is equal to or lower than a predetermined threshold value and the humidity measured by the first hygrometer is equal to or lower than a lower limit value of the predetermined range and is equal to or higher than a predetermined threshold value.

5. The humidifying device according to claim 1, wherein the hardware controller is configured to stop a cooling operation of the cooler in a case where the dew condensation detection unit detects the dew condensation.

6. The humidifying device according to claim 1, further comprising:

a fan that allows air to flow through the cooler, wherein the hardware controller is configured to control a rotating speed of the fan so that the rotating speed of the fan in a case where the dew condensation detected is higher than the rotating speed of the fan in a case where no dew condensation is detected.

7. The humidifying device according to claim 1, further comprising:

a third thermometer configured to measure a surface temperature of the cooler, wherein the hardware controller is configured to determine the cooling intensity of the cooler by using the temperature measured by the first thermometer, the humidity measured by the first hygrometer, and the temperature measured by the third thermometer.

8. The humidifying device according to claim 7, wherein hardware controller is further configured to execute a program to:

calculate a dew-point temperature by using the temperature measured by the first thermometer and the humidity measured by the first hygrometer, and wherein the hardware controller is configured to change the cooling intensity of the cooler in a case where a difference between the dew-point temperature calculated and the temperature measured by the third thermometer is equal to or higher than a predetermined value.

9. The humidifying device according to claim 1, wherein the hardware control is configured to weaken a cooling operation of the cooler in a case where the dew condensation is detected.

10. A humidifying device comprising:

a first thermometer configured to measure a temperature inside the humidifying device;

a first hygrometer configured to measure a humidity inside the humidifying device;

an air inlet;

an internal air passage through which air taken in from the air inlet passes;

an air outlet from which the air that has passed through the internal air passage is discharged;

a cooler installed in a path of the internal air passage; and a hardware controller configured to execute at least one program to control the cooler, wherein the hardware controller changes a cooling intensity of the cooler in a case where values measured by the first thermometer and the first hygrometer are out of a predetermined range, wherein hardware controller is further configured to execute a program to:

store a preset target humidity;

calculate a water content per unit substance amount based on values measured by the first thermometer and the first hygrometer, respectively;

calculate a target temperature by using the value calculated and the value stored by the target humidity storing unit;

estimate a temperature that is reachable in a case where air at the temperature measured by the first thermometer is cooled by the cooler; and notify a user, and wherein the hardware controller is configured to control the notification to the user in a case where the target temperature calculated for the target temperature is higher than the temperature estimated by a predetermined value or more.

11. A humidifying method comprising:

measuring a temperature by a first thermometer installed in a humidifying device;

measuring a humidity by a first hygrometer installed in the humidifying device;

determining whether the temperature measured by the first thermometer and the humidity measured by the first hygrometer are within a predetermined range; and controlling intensity of a cooler installed in a path between an air inlet and an air outlet, wherein the humidifying method further comprises:

installing a second thermometer between the cooler and the air outlet;

installing a second hygrometer between the cooler and the air outlet;

detecting that dew condensation has occurred in the humidifying device, by using the temperature measured by the first thermometer, the humidity measured by the first hygrometer, the temperature measured by the second thermometer, and the humidity measured by the second hygrometer, and calculating a water content per unit substance amount by using the temperature measured by the first thermometer and the humidity measured by the first hygrometer, and calculating a water content per unit substance amount by using the temperature measured by the second thermometer and the humidity measured by the second hygrometer, wherein it is determined that the dew condensation has occurred in a case where a difference between 1) a value calculated for the water content per unit substance amount by using the temperature measured by the first thermometer and the humidity measured by the first hygrometer and 2) a value calculated for the water content per unit substance amount by using the temperature measured by the second thermometer and the humidity measured by the second hygrometer, is equal to or greater than a predetermined value, and different cooling intensities are set for the cooler in a case where it is determined that the temperature and the humidity are within the predetermined range and in a case where it is determined that the temperature and the humidity are out of the predetermined range.

12. The humidifying method according to claim 11, further comprising:

storing a preset target humidity;

calculating a water content per unit substance amount based on values measured by the first thermometer and the first hygrometer, respectively;

calculating a target temperature by using the value calculated for the water content per unit substance amount by the first and the preset target humidity value stored;

estimating a temperature that is reachable in a case where air at the temperature measured by the first thermometer is cooled by the cooler; and notifying a user, wherein the notification to the user is controlled in a case where the target temperature calculated is higher than the temperature estimated by a predetermined value or more.

* * * * *